United States Patent [19]

Kobale et al.

[11] 4,242,372

[45] Dec. 30, 1980

[54] PROCESS FOR PRODUCING CONDUCTIVE/NON-CONDUCTIVE ADHESION LAYERS FOR LUMINESCENT MATERIALS ON FLAT/UNI-DIRECTIONALLY BENT SUBSTRATES FOR IMAGE DISPLAY DEVICES

[75] Inventors: Manfred Kobale, Faistenhaar; Rolf Wengert, Munich, both of Fed. Rep. of Germany

[73] Assignee: Siemens Aktiengesellschaft, Berlin & Munich, Fed. Rep. of Germany

[21] Appl. No.: 7,840

[22] Filed: Jan. 30, 1979

[30] Foreign Application Priority Data

Feb. 2, 1978 [DE] Fed. Rep. of Germany ..... 2804494

[51] Int. Cl.[3] ..... H01J 9/227

[52] U.S. Cl. ..... 427/68; 427/157

[58] Field of Search ..... 427/68, 108, 110, 419 G, 427/403, 64, 157

[56] References Cited

U.S. PATENT DOCUMENTS

| | | | |
|---|---|---|---|
| 3,582,389 | 6/1971 | Saulnier | 427/68 |
| 3,832,211 | 8/1974 | Cook | 427/68 |
| 3,940,508 | 2/1976 | Wilcox | 427/68 |
| 4,020,191 | 4/1977 | Nagashiro | 427/64 |

FOREIGN PATENT DOCUMENTS

| | | | |
|---|---|---|---|
| 2439301 | 3/1975 | Fed. Rep. of Germany | 427/68 |
| 2540132 | 4/1976 | Fed. Rep. of Germany . | |
| 50-81561 | 1/1975 | Japan | 427/68 |

*Primary Examiner*—James R. Hoffman

*Attorney, Agent, or Firm*—Hill, Van Santen, Steadman, Chiara & Simpson

[57] ABSTRACT

Luminescent materials are adhered to TV color picture screens or image display device screens by coating the inner surface of a glass screen substrate with a conductive or non-conductive $C_1$ to $C_4$ alcoholic or carboxylic solution containing oxygen-rich organic materials selected from the group consisting of silicon salts of relative low molecular weight carboxylic acids, tin salts of relatively low molecular weight carboxylic acids (which can be optionally doped to render them conductive, if desired) or mixtures thereof or a doped tin compound, at least partially drying such coating, as at a temperature of about 150° C., applying a select pattern of luminescent materials onto such partially dried coating and curing or tempering the resultant structure, as at a temperature of about 500° C. so that the luminescent material is firmly embedded within the conductive/-non-conductive coating.

12 Claims, 1 Drawing Figure

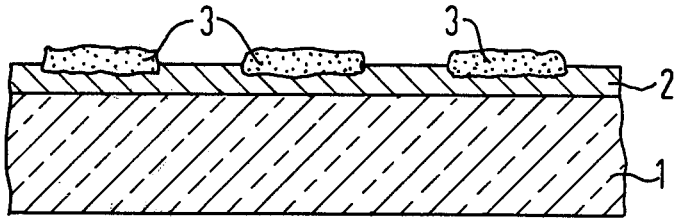
3
3
2
1

PROCESS FOR PRODUCING CONDUCTIVE/NON-CONDUCTIVE ADHESION LAYERS FOR LUMINESCENT MATERIALS ON FLAT/UNI-DIRECTIONALLY BENT SUBSTRATES FOR IMAGE DISPLAY DEVICES

BACKGROUND OF THE INVENTION

1. Field of the Invention

The invention relates to a process of producing electrically conductive or non-conductive layers for improved adhesion of luminescent materials on flat or uni-directionally bent substrates for color picture screens and image display device screens.

2. Prior Art

In order to attain a relatively long life span for luminescent image screens, good adhesion of the luminescent materials to the glass screen substrate is required. Further, it is desirable to treat the relatively soft glass surface on the side facing the phosphor or luminescent materials so as to reduce gas-ion eruptions during bombardment of such surface with electrons. It is also desirable to provide a conductive sub-layer on the glass surface which faces the luminescent materials so that electrical discharge can occur via such sub-layer and thereby prevent an electrostatic charge build-up on the glass substrate.

It is known to add water glass ($K_2SiO_3$) to luminescent material compositions and apply the resultant mixture to glass screen substrates and thereby attain improved adhesion of the luminescent materials to the glass screen while simultaneously attaining an increased cohesiveness of the luminescent material layer per se. With such a process, after a curing or tempering process, the individual luminescent material particles are connected with one another as well as with the glass substrate by a thin alkaline glass layer. It is also known to temper or harden glass screens by vapor depositing or sputtering silicon dioxide onto a surface of a glass screen.

Processes for producing patterned luminescent material layers for TV picture tubes or the like is known. For example, German Offenlegungsschrift No. 2,540,132 (which substantially correspondes to U.S. Pat. No. (4,020,191) discloses one such process whereby the luminescent material pattern is provided by a combination of printing and photographic techniques. In this process, the luminescent materials are mixed with light-sensitive materials and glass powder, applied to the glass surface, exposed, developed and then fused to the glass surface.

SUMMARY OF THE INVENTION

The invention provides a process for producing an image screen having a hardened glass inner surface, an adhesive means anchoring the luminescent material layer to the glass inner surface, a conductive or non-conductive layer between the luminescent material and the glass inner surface and a luminescent material which is not debased as ot its luminescent properties, particularly relative to low energy cathode ray excitation (lower than 10 keV).

In accordance with the principles of the invention, the process for producing such an image screen comprises coating a surface of a glass screen plate, before the application of a luminescent material pattern thereon, with an alcoholic or acidic solution containing an oxygen-rich organic silicon compound and/or a tincompound (which can optionally include dopant atoms therein), at least partially drying such coating by subjecting it to relatively low temperatures (i.e., below about 150° C.), applying a desired pattern of luminescent material onto such partially dried coating and thereafter subjecting the resultant stucture to a tempering or curing process at relatively high temperatures (i.e., above about 450° C.) so that such luminescent materials are firmly anchored or embedded in the silicon dioxide layer and/or tin oxide layer which is formed between the glass surface and the luminescent material.

In accordance with the principles of the invention, the silicon and/or tin salts utilized to anchor the luminescent materials onto the glass screens are relatively low molecular weight carboxylic acid salts, such as tetraacetoxysilanes and/or tetraacetoxystannates in aceto-acetic esters dissolved in alcohols or are halogenated silicon and/or tin salts which are at least partially substituted in their anions with acid radicals of relatively low molecular weight mono-and/or di-carboxylic acids, likewise dissolved in alocoholic solutions. However, other organo-metallic compounds, such as halogenides of silicon and/or tin which are at least partially substituted in their anions by acid radicals of relatively low molecular weight mono- and/or di-carboxylic acids and/or by hydroxyl radicals and/or alcohol radicals of relatively low molecular weight alcohols may also be utilized.

In accordance with the principles of the invention, when organic tin compounds are utilized and a conductive layer is desired between a glass screen surface and a luminescent material, suitable dopants, such as antimony or indium compounds, are admixed with the tin compounds prior to application thereof onto the glass surface.

In accordance with the principles of the invention, solvents for the silicon and/or tin salts are relatively low molecular weight alcohols and carboxylic acids which contain no more than four carbon atoms in their chain (i.e., $C_1$–$C_4$ alcohols and/or carboxylic acids).

In accordance with the principles of the invention, the thickness of the "anchoring" or adhesive layer applied to a glass screen surface is regulated so that it has a thickness, after drying, ranging from about 100 to 500 nm. In achieving such dried layer thickness, the initial wet layer is applied in a thickness averaging in the range of about 1 to 3 $\mu$m.

In accordance with an exemplary embodiment of the invention, a select silicon and/or tin salt solution is applied onto a glass screen surface by immersion, spraying or centrifuging and is dried at a temperature of about 150° C. At such relatively low temperatures, this layer remains relatively soft and ductile. Only at relatively high temperatures of up to about 500° C. does a hard, chemically-resistant silicon oxide and/or tin oxide layer form. After the silicon and/or tin salt layer is at least partially dried, a luminescent material suspension is applied thereon is a select pattern, as by sputtering or printing via a double-mask grid process. Thereafter, the resultant structure is tempered or cured at relatively high temperatures of at least about 450° C. In instances where silicon salts are applied, the resultant layer is electically non-conductive and in instances where doped tin salts are applied, the resultant layer is electrically conductive.

BRIEF DESCRIPTION OF THE DRAWINGS

The single FIGURE is and enlarged elevated cross-sectional fragmentary view of a glass substrate coated in accordance with the principles of the invention.

DESCRIPTION OF THE PREFERRED EMBODIMENT

As shown in the drawing, a glass substrate 1, which may be flat or uni-directionally bent, is provided with an adhesion or anchoring layer 2 composed of silicon dioxide and/or tin oxide and which may be doped as desired. A luminescent material pattern 3 is provided partially embedded within the anchoring layer 2. This structure is produced by coating a select surface of a glass substrate with a liquid solution containing a material selected from the group consisting of oxygen-rich organic silicon compounds, tin compounds, which may include select dopant atoms therein and mixtures thereof. Such layer may be applied by any conventional liquid coating technique, such as immersion, spraying, centrifuge or the like. After the application of a relatively thin and uniform layer, i.e., having a thickness of the average of about 1 to 3 μm, the so-coated glass substrate is subjected to a temperature of about 150° C. so that such layer is at least partially dried and is capable of receiving another layer of material thereon. Thereafter a select pattern of luminescent material is applied onto the partially dried layer and the resultant substrate is then subjected to temperature-time condition sufficient to convert the initial or adhesive layer into an oxide layer (silicon dioxide and/or tin oxide), such as by heating such substrate at a temperature in the range of about 450° to 500° C. in air for about 1 to 2 hours.

The resultant substrate exhibits a hardened or tempered surface, exhibits a good adhesion between the luminescent materials and the substrate via the silicon dioxide and/or tin oxide layer and exhibits, in instances were dopant material were admixed with the tin compounds, an electrical conductivety in the anchoring or adhesive layer and which can be soldered with an electrical lead for discharge of any electrostatic charge that may be built-up on such glass substrate.

With the foregoing general discussion in mind, there is now present detailed examples which will illustrate that those skilled in the art the manner in which the invention is carried out. However, these examples are not to be constructed as limiting the scope of the invention in any way.

EXAMPLE I

A silicon dioxide coating liquid comprised of a solution of tetraacetoxysilane, $Si(O_2C_2H_3)_4$ in aceto-acetic ester and ethanol, such as available under the commercial designation "Merck ZLI 90211) is applied, without additives and undiluted, via a fine atomizing spray onto a horizontally disposed substrate surface. A drip-free spraying pistol device is positioned above such substrate a distance of about 15 cm and is connected to a source of the above-described coating liquid and is then energized so as to spray a substantially uniform coating of such liquid onto the substrate surface until a layer thickness of about 3 μm is attained. The substrate is a flat or a uni-directionally bent glass screen.

After the application of the above-adhesive or anchoring layer, the so-coated substrate is dried at a maximum temperature of 150° C. until a tack-free surface is attained. Thereafter, luminescent materials are applied, for example via a double-mask grid process, further details of which are disclosed in copending Wengert et al patent application Ser. No. 007,837 filed Jan. 30, 1979. After the luminescent material has been applied, the substrate is heated in air at a temperature of about 450° C. for 1 to 2 hours. This causes the luminescent material to be firmly embedded into the adhesion layer which, during such heating, is condensing and forming a $SiO_2$ layer and provide extremly good adhesion between the luminescent material layer (i.e., the $SiO_2$ anchoring layer and the actual luminescent materials) and the substrate surface.

EXAMPLE II

A tin oxide coating liquid comprised of a solution of tetraacetoxystannate, $Sn\ (O_2C_2H_3)_4$ doped with antimony and in aceto-acetic ester and ethanol, such as available under the commercial designation "Merck ZLI 1079" is uniformly sprayed onto a substrate as in Example I, undiluted and with a drip-free spray means. The substrate is a glass screen of the type described in the above-reference copending Wengert et al patent application. After this adhesive or anchoring layer is dried at a temperature of about 100° C., a pattern of luminescent material is applied in the manner described in Example I. Then, the so-coated substrate is cured or tempered at a temperature of about 450° C. in air for 1 to 2 hours so that an antimony-doped tin oxide layer forms and firmly anchors the luminescent material therein. In this manner, the substantially simultaneous construction of a conductive layer beneath the luminescent material surface and a good adhesion of the luminescent material layer onto the substrate surface is attained.

As is apparent from the foregoing specification, the present invention is susceptible of being embodied with various alterations and modifications which may differ particularly from those that have been described in the peceeding specification and description. For this reason it is to be fully understood that all the foregoing is intended to be merely illustrative and is not to be construed or interpreted as being restrictive or otherwise limiting of the present invention, excepting as it is set forth and defined in the hereto-appended claims.

What is claimed is:

1. A process of producing adhering luminescent layers on flat or uni-directionally bent screen substrates of a color picture screen and image display screen, comprising:

coating a surface of said screen substrate with an adhesive liquid layer comprised of an alcoholic solution of oxygen-rich organic materials selected from the group consisting of silicon salts of relatively low molecular weight carboxylic acids, tin salts of relatively low molecular weight carboxylic acids and mixtures thereof;

at least partially drying said adhesive layer at a maximum temperature of about 150° C;

applying a layer of luminescent material onto said partially dried layer; and tempering both of said layers at a maximum temperature of about 500° C.

2. A process as defined in claim 1 wherein said liquid adhesive layer is coated onto the glass screen in such a thickness that after the partially drying of such coating, it has a thickness in the range of about 100 to 500 nm.

3. A process as defined in claim 1 wherein said liquid adhesive layer is coated onto the glass screen via immersion, spraying or centrifuge.

4. A process as defined in claim 1 wherein said luminescent materials are applied via a double-mask grid process.

5. A process as defined in claim 1 wherein said adhesive liquid layer is comprised of an alcoholic solution of a material selected from the group consisting of tetraacetoxysilane, tetraacetoxystannate and mixtures thereof.

6. A process as defined in claim 5 wherein said alcoholic solution is comprised of a mixture of an acetoacetic ester and a relatively low molecular weight alcohol.

7. A process as defined in claim 1 wherein said oxygen-rich organic materials are selected from the group consisting of halogenated silicon salts which are at least partially substituted in their anions with acid radicals of relatively low molecular weight mono- and/or di-carboxylic acids, halogenated tin salts which are at least partially substituted in their anions with acid radicals of relatively low molecular weight mono- and/or di-carboxylic acids and mixtures thereof.

8. A process as defined in claim 1 wherein said oxygen-rich organic materials are selected from the group consisting of halogenated silicon salts which are at least partially substituted in their anions with radicals selected from the group consisting of acid radicals of relatively low molecular weight mono- and/or di-carboxylic acids, hydroxyl radicals and alcohol radicals of relatively low molecular weight alcohols, halogenated tin salts which are at least partially substituted in their anions with radicals selected from the group consisting of acid radicals of relatively low molecular weight mono- and/or di-caboxylic acids, hydroxyl radicals and alcohol radicals of relatively low molecular weight alcohols, and mixtures thereof.

9. A process as defined in claim 1 wherein said adhesive layer is comprised of an alcoholic solution of tin salts of relatively low molecular weight carboxylic acids having dopant atoms therein.

10. A process as defined in claim 9 wherein said dopant atoms are selected from the group consisting of antimony and indium.

11. A process as defined in claim 1 wherein said alcoholic solution comprises a $C_1$ to $C_4$ liquid selected from the group consisting of alcohols and carboxylic acids.

12. A process as defined in claim 1 wherein said tempering occurs in air and over a period of time ranging between about 1 to 2 hours.

* * * * *